US008425075B1

(12) United States Patent
Falat et al.

(10) Patent No.: US 8,425,075 B1
(45) Date of Patent: Apr. 23, 2013

(54) LIGHTING MOUNTING DEVICE

(76) Inventors: Bruce P. Falat, Kingman, AZ (US); Kathy Brown, Kingman, AZ (US)

( * ) Notice: Subject to any disclaimer, the term of this patent is extended or adjusted under 35 U.S.C. 154(b) by 526 days.

(21) Appl. No.: 12/725,871

(22) Filed: Mar. 17, 2010

(51) Int. Cl.
*F21S 8/00* (2006.01)

(52) U.S. Cl.
USPC ..... 362/145; 362/249.16; 362/249.01; 362/152

(58) Field of Classification Search ..... 362/152, 362/145, 806, 249.16, 249.01
See application file for complete search history.

(56) References Cited

U.S. PATENT DOCUMENTS 4,712,165 A * 12/1987 Cetrone ..... 362/147
4,821,158 A 4/1989 Mitten
4,852,832 A 8/1989 Delaney
4,995,181 A 2/1991 Wolf
5,067,061 A 11/1991 Prickett
5,158,359 A * 10/1992 Penturelli ..... 362/221
5,386,353 A * 1/1995 Battaglia ..... 362/224
5,453,917 A * 9/1995 Ogawa ..... 362/222
5,791,762 A 8/1998 Wroblewski
D426,327 S 6/2000 Guzik
6,652,112 B1 * 11/2003 Lucarelli ..... 362/145
6,736,522 B1 * 5/2004 Cini ..... 362/145
8,092,048 B2 * 1/2012 Zheng ..... 362/249.06
8,215,786 B2 * 7/2012 Sloan et al. ..... 362/145

* cited by examiner

*Primary Examiner* — Anabel Ton

(57) ABSTRACT

A lighting mounting device that is fabricated from a number of hollow, flexible tubes, which can be interconnected by a series of elbows. Each of the tubes also has a slit, which allows a continuous string of lights to be mounted directly adjacent to the tubes. The string of lights can be connected via a plug to an electrical outlet that provides standard household electricity, with the tubes being positioned in a square or square-like configuration to allow the tubes to be mounted adjacent to a door frame or window frame for easy display.

8 Claims, 3 Drawing Sheets

LIGHTING MOUNTING DEVICE

BACKGROUND OF THE INVENTION

The present invention concerns that of a new and improved lighting mounting device that is fabricated from a number of hollow, flexible tubes that can be interconnected by a series of elbows, allowing a continuous string of lights to be mounted on the tubes.

SUMMARY OF THE INVENTION

The present invention concerns that of a new and improved lighting mounting device that is fabricated from a number of hollow, flexible tubes that can be interconnected by a series of elbows. Each of the tubes also has a slit, which allows a continuous string of lights to be mounted directly adjacent to the tubes. The string of lights can be connected via a plug to an electrical outlet that provides standard household electricity, with the tubes being positioned in a square or square-like configuration to allow the tubes to be mounted adjacent to a door frame or window frame for easy display.

There has thus been outlined, rather broadly, the more important features of a lighting mounting device that the detailed description thereof that follows may be better understood and in order that the present contribution to the art may be better appreciated. There are, of course, additional features of the lighting mounting device that will be described hereinafter and which will form the subject matter of the claims appended hereto.

In this respect, before explaining at least one embodiment of the lighting mounting device in detail, it is to be understood that the lighting mounting device is not limited in its application to the details of construction and to the arrangements of the components set forth in the following description or illustrated in the drawings. The lighting mounting device is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present lighting mounting device. It is important, therefore, that the claims be regarded as including such equivalent constructions insofar as they do not depart from the spirit and scope of the present invention.

It is therefore an object of the present invention to provide a lighting mounting device which has all of the advantages of the prior art and none of the disadvantages.

It is another object of the present invention to provide a lighting mounting device which may be easily and efficiently manufactured and marketed.

It is another object of the present invention to provide a lighting mounting device which is of durable and reliable construction.

It is yet another object of the present invention to provide a lighting mounting device which is economically affordable and available for relevant market segment of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
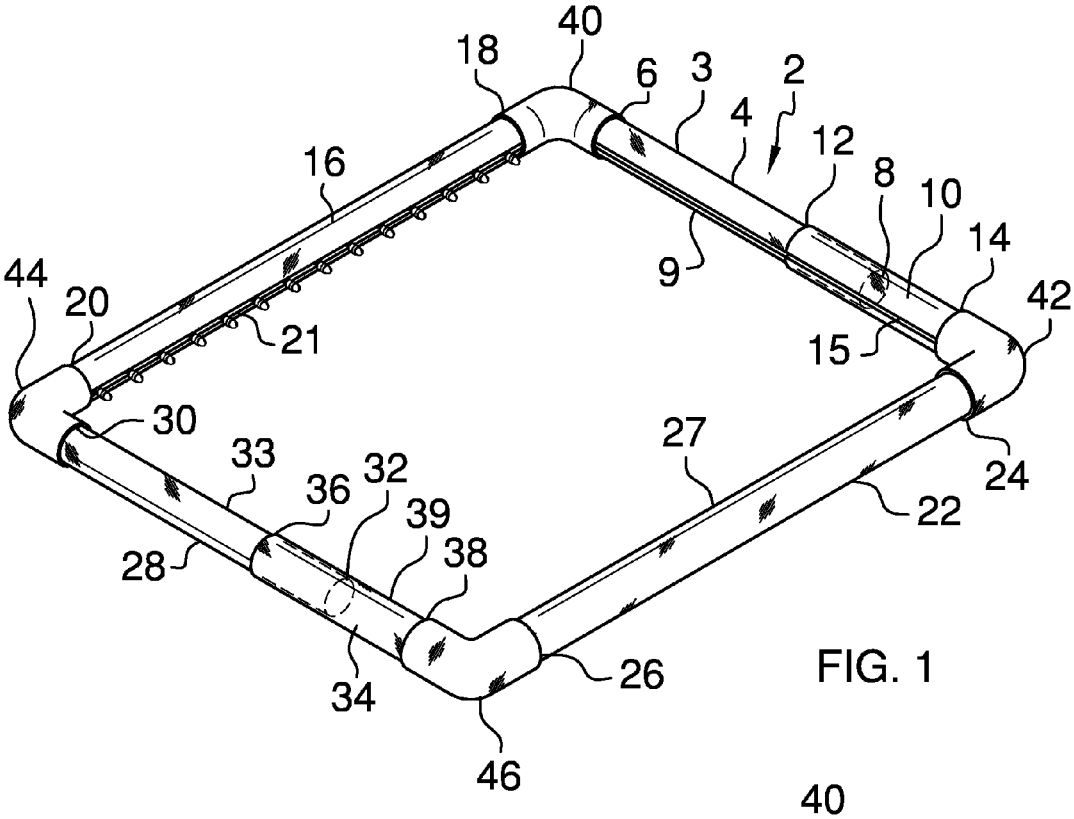
FIG. 1 shows an upper front perspective view of the preferred embodiment of the present invention, showing a plurality of hollow, flexible tubes in a box-like configuration.
Figure 2:
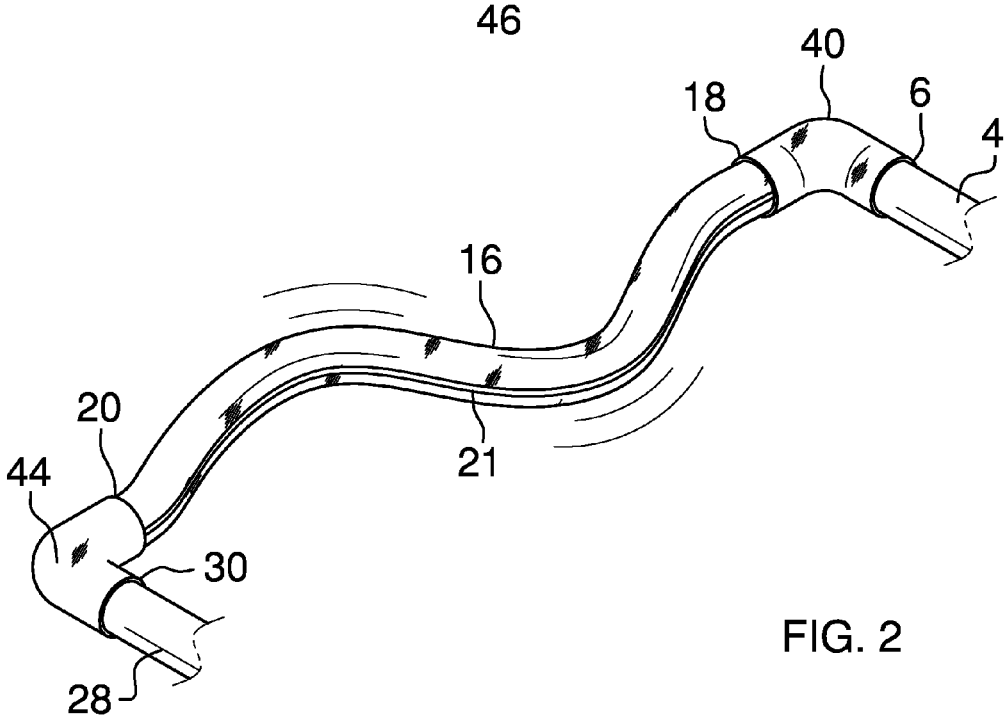
FIG. 2 shows an upper front perspective view of the preferred embodiment of the present invention, showing the left side tube in order to emphasize the flexibility of the tube.
Figure 3:
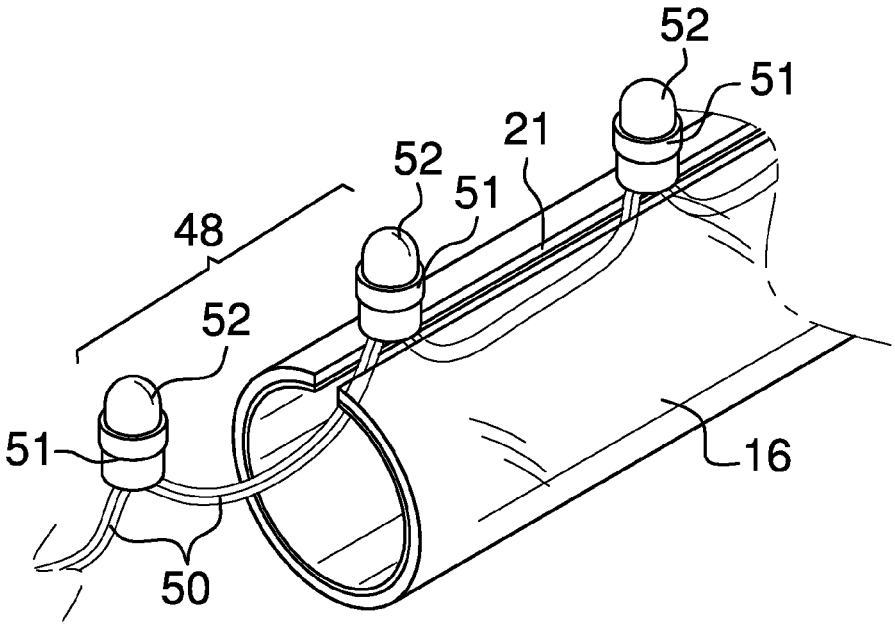
FIG. 3 shows an upper perspective view of a slit on a tube and emphasizing how the string of lights and the wiring is adjacent to the slit.

With reference now to the drawings, and in particular to FIGS. 1 through 5 thereof, a new lighting mounting device embodying the principles and concepts of the present invention and generally designated by the reference numeral 2 will be described.

As best illustrated in FIGS. 1 through 5, the preferred embodiment of the lighting mounting device 2 comprises a frame 3, with the frame 3 comprising a left upper tube 4 that has two ends comprising a first end 6 and a second end 8 and a right upper tube 10 that has two ends comprising a first end 12 and a second end 14. The second end 8 of the left upper tube 4 is insertable into the first end 12 of the right upper tube 10.

The left upper tube 4 has a slit 9 running from the first end 6 of the left upper tube 4 to the second end 8 of the left upper tube 4, while the right upper tube 10 has a slit 15 running from the first end 12 of the right upper tube 10 to the second end 14 of the right upper tube 10. When the left upper tube 4 and the right upper tube 10 are connected to one another, the slits 9 and 15 are preferably aligned and co-planar with one another.

The frame 3 of the lighting mounting device 2 also comprises a left side tube 16 that has two ends comprising a first end 18 and a second end 20. The first end 18 of the left side tube 16 is connected to an upper left elbow 40, while the first end 6 of the left upper tube 4 is also connected to the upper left elbow 40. The left side tube 16 and the left upper tube 4 are mounted in such a way that they are approximately offset about 90 degrees from one another.

The frame 3 of the lighting mounting device 2 also comprises a right side tube 22 that has two ends comprising a first end 24 and a second end 26. The first end 24 of the right side tube 22 is connected to an upper right elbow 42, while the second end 11 of the right upper tube 10 is also connected to the upper right elbow 42. The right side tube 22 and the right upper tube 10 are mounted in such a way that they are approximately offset about 90 degrees from one another.

Both the left side tube 16 and the right side tube 22 are designed to have a slit 21 and 27 in them, respectively, with the slit 21 in the left side tube 16 and the slit 27 in the right side tube 22 designed to be co-planar with the slits 9 and 15.

The frame 3 of the lighting mounting device 2 also comprises a left lower tube 28 that has two ends comprising a first end 30 and a second end 32 and a right lower tube 34 that has two ends comprising a first end 36 and a second end 38. The second end 32 of the left lower tube 28 is insertable into the first end 36 of the right lower tube 34.

The left lower tube 28 has a slit 33 running from the first end 30 of the left lower tube 28 to the second end 32 of the left lower tube 28, while the right lower tube 34 has a slit 39 running from the first end 36 of the right lower tube 34 to the second end 38 of the right lower tube 34. When the left lower tube 28 and the right lower tube 34 are connected to one another, the slits 33 and 39 are preferably aligned and co-planar with one another, along with being co-planar with the other slits 9, 15, 21, and 27 already disclosed.

The first end 30 of the left lower tube 28 is connected to a lower left elbow 44, with the second end 20 of the left side tube 16 also being connected to the lower left elbow 44. Also, the second end 38 of the right lower leg 34 is connected to a lower right elbow 46, with the second end 26 of the right side leg 22 also being connected to the lower right elbow 46.

A string of lights 48 that is designed to be placed within each of the tubes 4, 10, 16, 22, 28, and 34, as well as being strung through each of the elbows 40, 42, 44, 46 that happen to join successive tubes to one another. The string of lights 48 comprises a length of wiring 50 that has a plurality of housings 51 attached to it. A light 52 is located within each housing 51. Each housing 51 and corresponding light 52 is designed to be located outside of a tube adjacent to its respective slit, while the length of wiring 50 that is located in between each two adjacent housings is designed to be partially or totally hidden from outside observation of the lighting mounting device 2 because it is placed within the respective tube through the corresponding slit.

Figure 4:
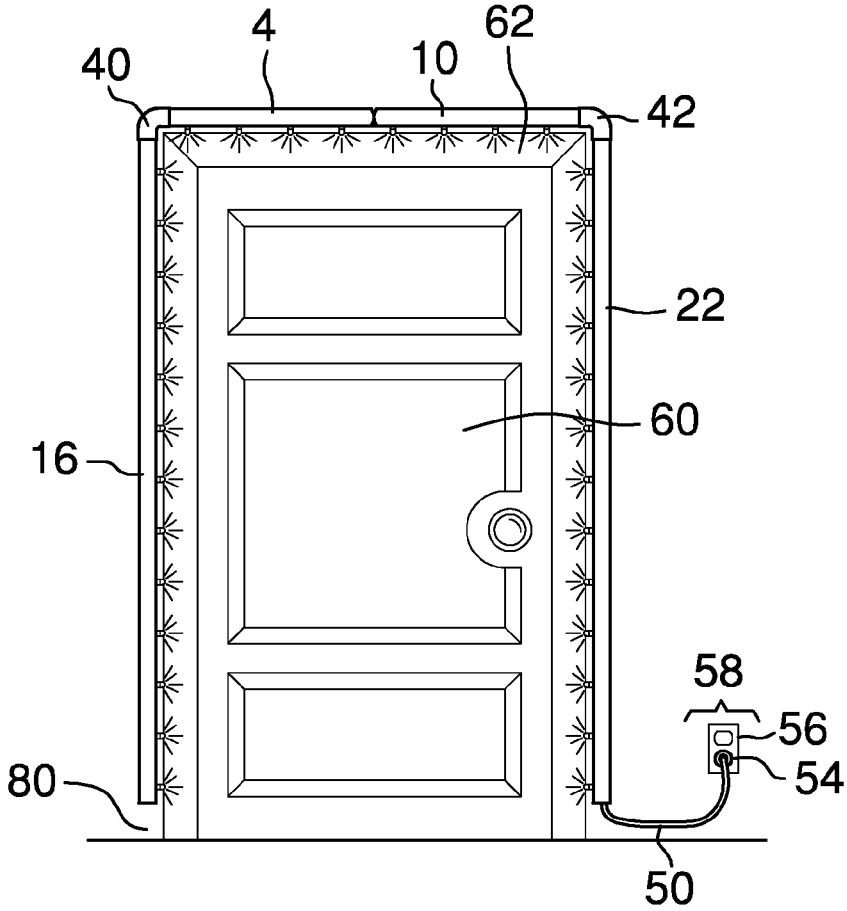
FIG. 4 shows a front view of an embodiment of the lighting mounting device as it would appear attached adjacent to a door frame surrounding a door.

FIG. 4 shows an alternative embodiment of the present invention, with the frame 3 of the lighting mounting device 2 not having a left lower tube 28 or a right lower tube 34, nor possessing a lower left elbow 44 or a lower right elbow 46. The frame 3 of the lighting mounting device 2 is attached to a structure 80 adjacent to a door frame 62 surrounding a door 60. This embodiment, like all of the embodiments, has the wiring 50 of the string of lights 48 connected to a plug 54, which in turn is connected to an electrical outlet 56 that has standard household current 58.

Figure 5:
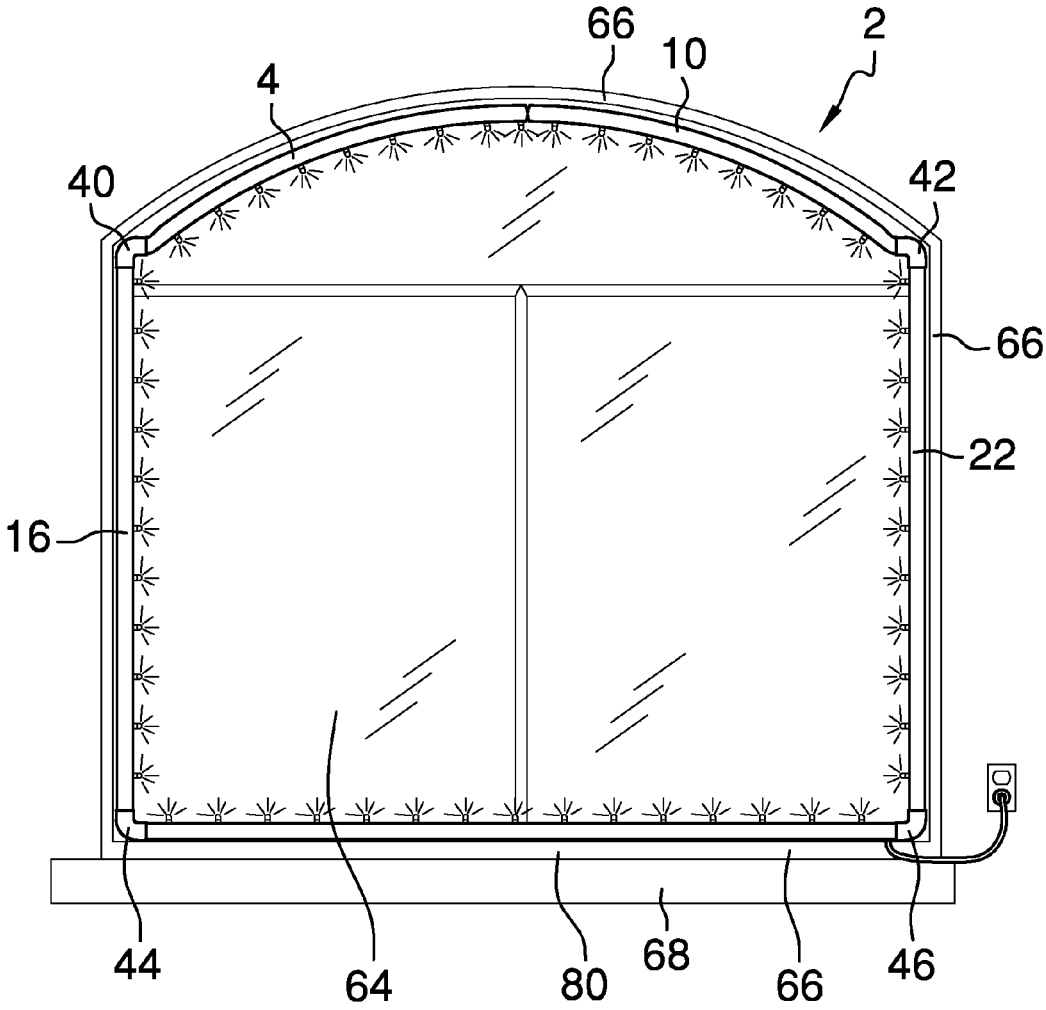
FIG. 5 shows a front view of an embodiment of the lighting mounting device as it would appear attached adjacent to a window frame surrounding a window.

FIG. 5 is another embodiment of the lighting mounting device 2, with the left upper tube 4 and the right upper tube 10 designed to be a little bit longer, cumulatively, than the left lower leg 28 and the right lower leg 34, cumulatively. This allows the frame 3 of the lighting mounting device 2 to be attached on a structure 80 adjacent to a window frame 66 around a window 64 such that the left upper tube 4 and the right upper tube 10 is curved upward and outward in a semi-circular shape. The left lower leg 28 and the right lower leg 34, together, are mounted immediately above the window sill 68, which is located immediately below the window frame 66.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What we claim as our invention is:

1. A lighting mounting device comprising a frame, means for providing lighting to the frame, a left upper tube having two ends comprising a first end and a second end, the left upper tube also having a slit running from the first end of the left upper tube to the second end of the left upper tube, a right upper tube having two ends comprising a first end and a second end, the right upper tube also having a slit running from the first end of the right upper tube to the second end of the right upper tube, wherein the second end of the left upper tube is insertable into the first end of the right upper tube, an upper left elbow tube, wherein the upper left elbow tube is attached to the first end of the left upper tube, a left side tube having two ends comprising a first end and a second end, the left side tube also having a slit running from the first end of the left side tube to the second end of the left side tube, wherein the first end of the left side tube is also connected to the upper left elbow tube, an upper right elbow tube, wherein the upper right elbow tube is attached to the second end of the right upper tube, a right side tube having two ends comprising a first end and a second end, the right side tube also having a slit running from the first end of the right side tube to the second end of the right side tube, wherein the first end of the right side tube is also connected to the upper right elbow tube, a lower left elbow tube, wherein the lower left elbow tube is attached to the second end of the left side tube, a lower right elbow tube, wherein the lower right elbow tube is attached to the second end of the right side tube, a left lower tube having two ends comprising a first end and a second end, the left lower tube also having a slit running from the first end of the left lower tube to the second end of the left lower tube, wherein the first end of the left lower tube is also attached to the lower left elbow tube, a right lower tube having two ends comprising a first end and a second end, the right lower tube also having a slit running from the first end of the right lower tube to the second end of the right lower tube, wherein the second end of the left lower tube is insertable into the first end of the right lower tube, further wherein the second end of the right lower tube is also attached to the lower right elbow tube, wherein the means for providing lighting to the frame further comprises a length of wiring, means for attaching lighting to the length of wiring, and means for providing power to the length of wiring.

2. A lighting mounting device according to claim 1 wherein the means for attaching lighting to the length of wiring further comprises (a) a plurality of housings attached to the length of wiring, (b) a plurality of individual lights, where one light of the plurality of individual lights is attached to each housing, (c) wherein each of the housings and associated individual light is placed outside of a tube adjacent to said tube's respective slit, while a portion of the length of wiring that is located between each two adjacent housings is configured to be disposed within the respective tube through the corresponding slit.

3. A lighting mounting device according to claim 2 wherein the means for providing power to the length of wiring further comprises (a) a plug attached to the wiring, (b) an electrical outlet, the electrical outlet being connected to standard household current, (c) wherein the plug is connected to the electrical outlet, thereby providing power to the length of wiring.

4. A lighting mounting device according to claim 3 wherein the frame is mounted to a structure, the structure further comprising (a) a door, (b) a door frame adjacent to the door, (c) wherein the frame of the lighting mounting device is mounted adjacent to the door frame.

5. A lighting mounting device according to claim 3 wherein the frame is mounted to a structure, the structure further comprising (a) a window, (b) a window frame located adjacent to the window, (c) a window sill located adjacent to the window, (d) wherein the frame of the lighting mounting device is mounted adjacent to the window frame and above the location of the window sill.

6. A lighting mounting device comprising a frame, the frame further comprising a left upper tube having two ends comprising a first end and a second end, the left upper tube also having a slit running from the first end of the left upper tube to the second end of the left upper tube, a right upper tube having two ends comprising a first end and a second end, the right upper tube also having a slit running from the first end of the right upper tube to the second end of the right upper tube, wherein the second end of the left upper tube is insertable into the first end of the right upper tube, an upper left elbow tube, wherein the upper left elbow tube is attached to the first end of the left upper tube, a left side tube having two ends comprising a first end and a second end, the left side tube also having a slit running from the first end of the left side tube to the second end of the left side tube, wherein the first end of the left side tube is also connected to the upper left elbow tube, an upper right elbow tube, wherein the upper right elbow tube is attached to the second end of the right upper tube, a right side tube having two ends comprising a first end and a second end, the right side tube also having a slit running from the first end of the right side tube to the second end of the right side tube, wherein the first end of the right side tube is also connected to the upper right elbow tube, a lower left elbow tube, wherein the lower left elbow tube is attached to the second end of the left side tube, a lower right elbow tube, wherein the lower right elbow tube is attached to the second end of the right side tube, a left lower tube having two ends comprising a first end and a second end, the left lower tube also having a slit running from the first end of the left lower tube to the second end of the left lower tube, wherein the first end of the left lower tube is also attached to the lower left elbow tube, and a right lower tube having two ends comprising a first end and a second end, the right lower tube also having a slit running from the first end of the right lower tube to the second end of the right lower tube, wherein the second end of the left lower tube is insertable into the first end of the right lower tube, further wherein the second end of the right lower tube is also attached to the lower right elbow tube, and means for providing lighting to the frame, said means further comprising a length of wiring, means for attaching lighting to the length of wiring, said means further comprising a plurality of housings attached to the length of wiring, a plurality of individual lights, where one light of the plurality of individual lights is attached to each housing, wherein each of the housings and associated individual light is placed outside of a tube adjacent to said tube's respective slit, while the portion of the length of wiring that is located between each two adjacent housings is configured to be disposed within the respective tube through the corresponding slit, and means for providing power to the length of wiring, said means further comprising a plug attached to the wiring, an electrical outlet, the electrical outlet being connected to standard household current, wherein the plug is connected to the electrical outlet, thereby providing power to the length of wiring.

7. A lighting mounting device according to claim 6 wherein the frame is mounted to a structure, the structure further comprising (a) a door, (b) a door frame adjacent to the door, (c) wherein the frame of the lighting mounting device is mounted adjacent to the door frame.

8. A lighting mounting device according to claim 6 wherein the frame is mounted to a structure, the structure further comprising (a) a window, (b) a window frame located adjacent to the window, (c) a window sill located adjacent to the window, (d) wherein the frame of the lighting mounting device is mounted adjacent to the window frame and above the location of the window sill.

* * * * *